US006230344B1

(12) United States Patent
Thompson et al.

(10) Patent No.: US 6,230,344 B1
(45) Date of Patent: May 15, 2001

(54) ADJUSTABLE BED

(75) Inventors: Ralph N. Thompson, Burlington; Donald A. Muir, Beamsville, both of (CA)

(73) Assignee: M.C. Healthcare Products Inc., Beamsville (CA)

( * ) Notice: Subject to any disclaimer, the term of this patent is extended or adjusted under 35 U.S.C. 154(b) by 0 days.

(21) Appl. No.: 09/328,343

(22) Filed: Jun. 9, 1999

(51) Int. Cl.[7] ..... A61G 7/012; A61G 7/015; A61G 7/018

(52) U.S. Cl. ..... 5/611; 5/616

(58) Field of Search ..... 5/611, 616, 617, 5/618, 613

(56) References Cited

U.S. PATENT DOCUMENTS

| | | | | |
|---|---|---|---|---|
| 3,462,772 | | 8/1969 | Morrison . | |
| 4,097,939 | | 7/1978 | Peck et al. . | |
| 4,638,516 | * | 1/1987 | Vrzalik | 5/611 |
| 5,095,562 | | 3/1992 | Alexander | 5/616 |
| 5,205,004 | * | 4/1993 | Hayes et al. | 5/611 |
| 5,245,718 | | 9/1993 | Krauska | 5/611 |
| 5,257,428 | | 11/1993 | Carroll et al. | 5/620 |
| 5,613,255 | * | 3/1997 | Bish et al. | 5/611 |
| 5,669,090 | | 9/1997 | Basgall | 5/620 |

* cited by examiner

*Primary Examiner*—Alexander Grosz
(74) *Attorney, Agent, or Firm*—Robert F. Delbridge

(57) ABSTRACT

The invention provides an adjustable bed frame having a main support including head and foot ends. The support is movable between raised and lowered positions and independent first and second elevating mechanisms are coupled to the main support. The mechanisms are spaced from one another on the main support to carry the bed frame on a support surface. An electrical supply system provides power to actuate the mechanisms to change the height of the main support above the support surface and a controller is coupled to the supply system to selectively activate the first and second elevating mechanisms to move the main support between raised and lowered positions. DC motors and worm drives are used independently to drive the elevating mechanisms and stops are provided at the raised and lowered positions to ensure that the main support is horizontal in the raised and lowered positions.

15 Claims, 3 Drawing Sheets

ADJUSTABLE BED

FIELD OF THE INVENTION

This invention relates to adjustable beds and more particularly to bed frames used in such beds. The bed frames are of the type which provide for elevation of a main support between raised and lowered positions and are particularly suitable for use by patients who require that the bed be lowered into a minimal height position.

BACKGROUND OF THE INVENTION

Adjustable bed frames are available in many forms. Mechanisms used to elevate and lower the bed frames include electro-mechanical, pneumatic, cable and pulley, and various devices involving a variety of mechanical linkages. In general, the structures include a main support and a pair of mechanisms located at the respective head and foot ends of the main support. The mechanisms are operable to change the elevation of the main support and in some cases to change the longitudinal orientation of the main support relative to horizontal. Such structures are often complicated require mechanical interconnection between the mechanisms to ensure that during elevation the main support is maintained in a fixed relationship to the horizontal.

The present invention is intended to provide an adjustable bed frame capable of being lowered as close to a support surface as possible while providing access under the bed frame for the feet of a patient lifting device and also maintaining the option of elevating the bed fame into a normal position for use.

SUMMARY OF THE INVENTION

In one of its aspects the invention provides an adjustable bed frame having a main support including head and foot ends. The support is movable between raised and lowered positions and independent first and second elevating mechanisms are coupled to the main support. The mechanisms are spaced from one another on the main support to carry the bed frame on a support surface. An electrical supply system provides power to actuate the mechanisms to change the height of the main support above the support surface and a controller is coupled to the supply system to selectively activate the first and second elevating mechanisms to move the main support between raised and lowered positions.

Preferably each of the first and second elevating mechanisms includes a DC motor and a worm drive coupled to the DC motor. The worm drive has stops corresponding to the raised and lowered positions so that on using the controller to move the independent first and second elevating mechanisms to bring the main support into said raised or lowered positions, the worm drives will meet the corresponding stops to ensure the main support is horizontal in the raised and lowered positions.

DESCRIPTION OF THE PREFERRED EMBODIMENT

Figure 1:
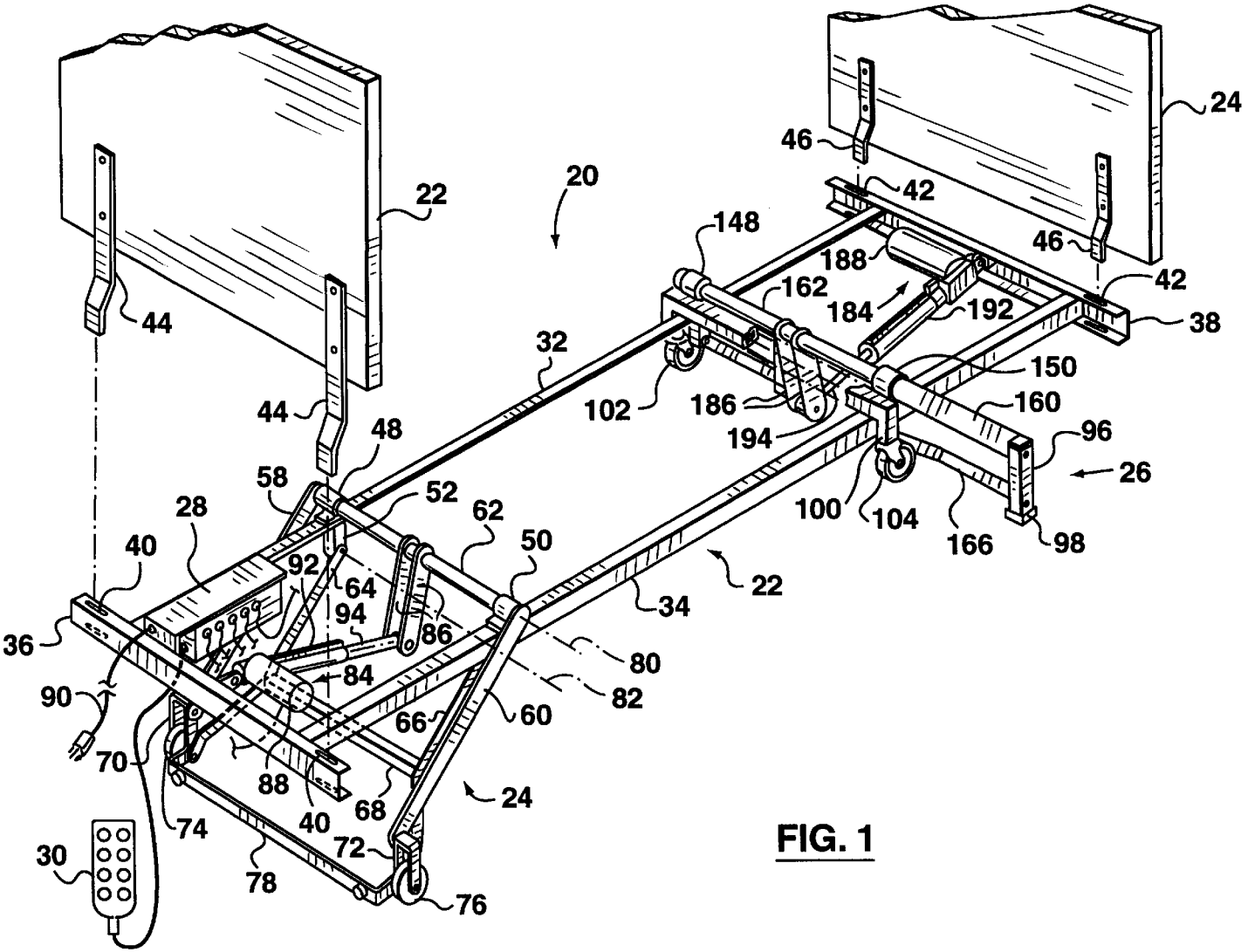
FIG. 1 is a partially exploded isometric view of a bed frame according to the invention and ready to receive a mattress support structure, the bed frame being shown in a raised position.

Reference is first made to FIG. 1 to describe a bed frame designated generally by the numeral 20. The bed frame is shown in a raised position about to receive a headboard 22 and footboard 24 and consists essentially of an elongate main support 22 carried by a pair of first and second independent elevating mechanisms 24, 26 powered by an electrical supply system 28. A controller is connected to the supply system 28 to permit a user to elevate and lower the bed. The independent elevating mechanisms 24, 26 are similar but differ in detail as will be explained. The movements of the mechanisms 24, 26 are independent in the sense that they are not mechanically connected but are driven simultaneously by the electrical supply system 28 when directed to do so by the controller 30. They independently meet raised and lowered positions so that if one of the mechanisms 24, 26 lags behind the other sightly, the mechanisms will reset on meeting either the raised or the lowered positions. This will be more fully explained later.

Returning to the structure of the bed frame, it will be seen that the main support 22 consist of inverted L-shaped side members 32, 34 extending longitudinally and arranged in parallel and defining the length of the bed frame. The side members 32, 34 have respective head and foot ends meeting corresponding channel-sectioned head and foot members 36, 38 which define respective slots 40, 42. Brackets 44, 46 on the respective head and footboards 22, 24 are made to slide vertically into the respective slots 40, 42 so that the head and footboards can be dropped into place by engagement of the brackets 44, 46 in the slots 40, 42, and removed by reversing the procedure.

Figure 2:
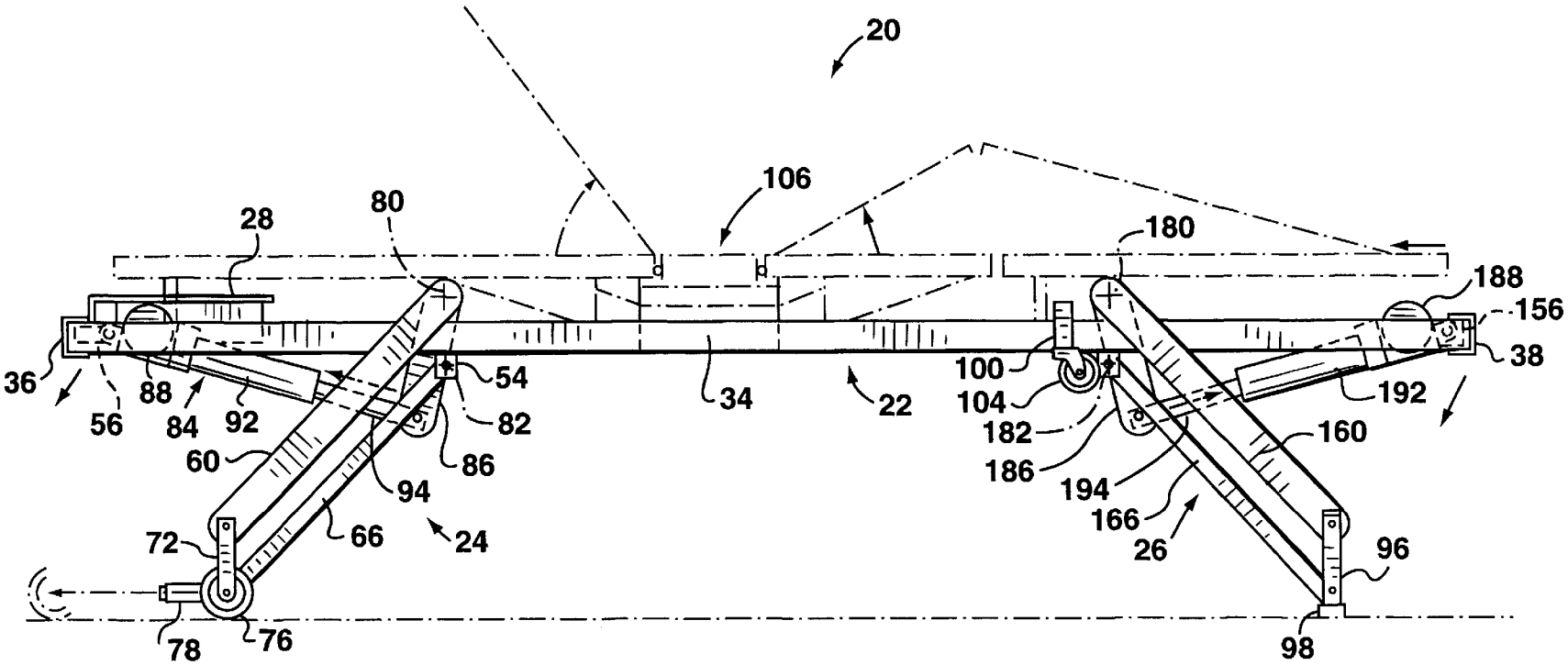
FIG. 2 is a side view of the bed frame showing the mattress support structure in ghost outline and indicating movement of parts of the bed frame when moving from the raised position (as shown) towards a lowered position.

Reference is next made to FIGS. 1 and 2 to describe the elevating mechanism 24 which is similar to the elevating mechanism 26 but, as mentioned previously, differs in detail. Once the mechanism 24 has been described, the differences between that mechanism and mechanism 26 will be explained.

The mechanism 24 has a parallel linkage which is attached to the side members 32, 34 at respective trunnions 48, 50 mounted above the side members 32, 34 and at a pair of bearing blocks 52, 54 mounted below the trunnions 48, 50 on the underside of the side members 32, 34. The elevating mechanism 24 is also attached at a pivot block 56 which can be better seen in FIG. 2. This block is attached to the head member 36.

The mechanism 24 includes parallel outer links 58, 60 connected by a transversely extending shaft 62 which is fixed to the outer links 58, 60 and passes through the trunnions 48, 50 to permit rotation of the assembly relative to the axis of the shaft 62. Similarly, a pair of inner links 64, 66 are independently pivotally attached to the respective pivot bearing blocks 52, 54 and the inner links 64, 66 are fixed in relation to one another by a transverse member 68 welded to the links. Unlike the outer links 58, 60, the inner links 64, 66 are not straight. The links 64, 66 are cranked outwardly below the transverse member 68 in order to bring the lower ends (as drawn) of the inner links 64, 66 into alignment with the corresponding ends of the outer links 58, 60 to facilitate pivotal attachment to upright elements 70, 72. These elements carry respective wheels 74, 76 mounted on a transverse axis and a bumper rail 78 is provided to locate the bed against a wall when the bed is in the lowered position as will be described with reference to FIG. 3.

The outer links 58, 60 and inner links 64, 66 are rotatable about respective transverse first and second parallel axes 80,

82 positioned one above the other. The axes 80, 82 are arranged so that the upright elements 70, 72 are maintained in a vertical orientation as the outer and inner links rotate about the respective axes 80, 82. Consequently the wheels 74, 76 are continuously in contact with the support surface regardless of the orientation of the outer and inner links 58, 60 and 64, 66.

The elevating mechanism 24 also includes an electrically driven actuator 84 connected to the pivot block 56 and to a pair of cranks 86 attached to the shaft 62. The actuator 84 is pivotally connected between the cranks 86 so that operation of the actuator 84 will create a turning force around the axis 80 and this will drive the mechanism 24 to either raise or lower the main support 22. The actuator 84 includes a DC motor 88 which receives DC power from the supply system 28 which has a connection lead 90 to receive AC power. The system 28 converts AC input to DC output to supply the motor 88. In turn, the motor powers a worm drive 92 which causes a rod 94 to move linearly outwardly and inwardly thereby rotating the cranks 86. It will now be evident from FIG. 2 particularly, that operation of the actuator 84 can cause the outer links 58, 60 to rotate about the axis 80. The inner links 64, 66 act as slave links in that they simply maintain the relationship of the upright elements 70, 72 as the links 58, 60 are driven to move angularly.

The actuators 84 are preferably made by Linak A/S of Denmark, Model No. LA31.

The actuator 84 has a high mechanical advantage so that it is capable of lifting heavy loads which could be found for instance when a patient or visitor sits on the end of a bed. This extreme situation will not normally exist when changing the elevation of the main support, but nevertheless, the actuator 84 is designed to change the elevation of the bed in such conditions. Before discussing this in detail, the mechanism 26 will be described.

Those parts in mechanism 26 which are similar to those described with reference to mechanism 24 will be indicated with numerals which are similar to those in mechanism 24 but increased by 100. For instance, outer link 60 in mechanism 24 has a corresponding link 160 in mechanism 26. The differences between mechanisms 24 and 26 lie in the slightly different purpose given to the mechanism 26. Whereas the mechanism 24 always has the wheels 74, 76 on the support surface, mechanism 26 includes a pair of upright elements 96 (one of which can be seen) which terminate in padded feet 98 which are shown resting on the support surface to locate this mechanism on the support surface. Consequently, when the bed is moved vertically, the resulting change in length between the wheels 74, 76 and the padded feet 98 is accommodated by the wheels 74, 76 rolling on the support surface (as indicated in FIG. 2) while the padded feet 98 remain stationary on the support surface. This will be more fully explained with reference to FIG. 3.

Figure 3:
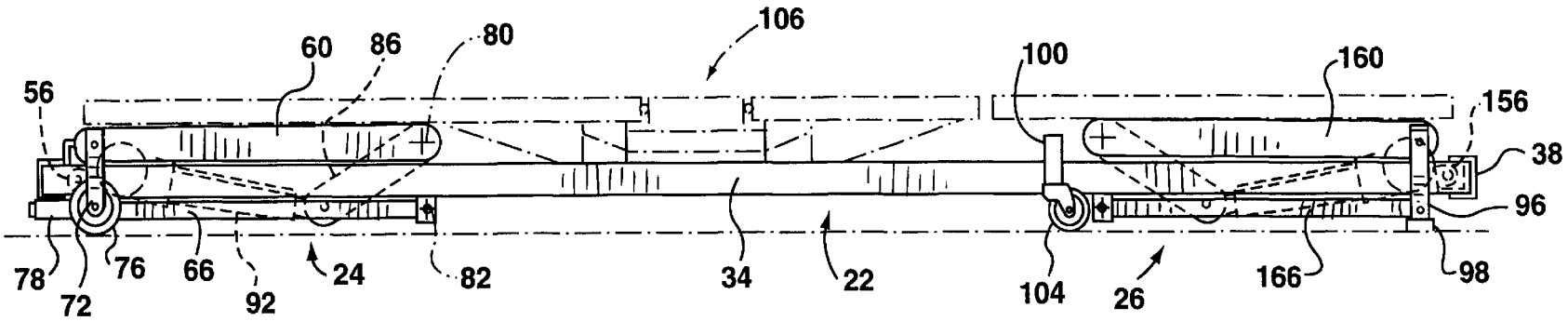
FIG. 3 is a view similar to FIG. 2 and showing the bed in the lowered position.

The mechanism 26 does not include wheels but a castor assembly 100 is provided attached to the main support 22 and including castors 102, 104 which will only come into contact with the support surface when the bed frame is in the lowered position as shown in FIG. 3.

FIG. 2 also illustrates in ghost outline how a mattress support 106 is assembled on the main support 22 and includes the usual adjustments for Trendelenburg positions.

Reference is next made to FIGS. 2 and 3 to describe how the bed frame is adjusted to change the height of the main support. It will be seen in FIG. 2 that the main support 22 is in an elevated condition in which the mechanisms 24, 26 have been activated by rotating the respective cranks 86, 186 about respective axes 80, 180 thereby rotating the outer links 58, 60 and 158, 160. The first upright elements 70, 72 and second upright elements 96 are maintained in a vertical orientation as was described previously by the combination of the associated links. The bed frame is supported on the wheels 74, 76 and on the padded feet 98 which engage the floor to limit the likelihood of accidental movement.

When it is desired to lower the main support 22, the controller 30 is actuated which in turn causes power to be provided through the supply system 28 to the DC motors 88, 188. The result is that the worm drives 92, 192 operate to withdraw the shafts 94, 194 thereby turning the cranks 86, 186 so that the wheels 74, 76 will move to the left as shown in FIG. 2 and the main support 22 of the bed frame 20 will be lowered as this happens. The movement will continue until the actuators 84, 184 reach the ends of their travels, which may be exactly at the same moment, or there could be a slight lag one after the other. This possible lag is immaterial because the actuators will continue independently to meet their individual limits to travel resulting in the main support reaching the position shown in FIG. 3. In this position, the movement of the actuator 26 is such that the padded feet 98 are raised slightly off the support surface as the castors 102, 104 come into play. The bed is then supported on these castors and on the permanently supporting wheels 74, 76 in the mechanism 24. The bed can now be moved in any direction because the castors 102, 104 can rotate about respective vertical axes as they roll on the support surface.

FIG. 3 illustrates an important aspect of the invention. As seen in this figure, links 60 and 160 are in horizontal alignment and positioned slightly above a plane containing the upper surface of the side member 34. Similarly, the inner links 66 and 166 are also in horizontal alignment and positioned below the side member 34. It will be appreciated that it is necessary to have a significant separation between the parallel axes 80, 82 and similarly between axes 180, 182 in order to provide stability. If these axes are too close, there will be limited stability in the parallel linkage provided by the outer and inner links 60, 66 and 160, 166. Consequently, in order to provide a compact and very low bed frame in the lowered position, it is necessary to accommodate the separation between these axes while at the same time maintaining a very compact arrangement. This has been achieved as can be seen in FIG. 3 while providing space under the main support 22 between the mechanisms 24, 26. This space results in part because the mechanisms 24, 26 are independent and not connected by mechanical hardware which would likely take up some of the space. As a result, there is adequate clearance space to receive the feet of lifting equipment used to move patients, and the location of the space is such that the equipment can be located above the patient in the ideal position for lifting.

Upon elevating the main support 22, the cranks 86, 186 will be rotated back towards the position shown in FIG. 2. As this happens, the padded feet 98 will come into contact with the support surface to stabilize the position of the bed and the wheels 74, 76 will roll to allow the change in length as the wheels 74, 76 move towards the padded feet 98.

Although not shown in the drawings, it will be evident that because the mechanisms 24, 26 are independent, the electrical supply system can be arranged to drive one or the other of the motors 88, 188 thereby tilting the main support either with the head down or the foot down. The bed can then be brought back to horizontal using the controller and judging the position of the main support with reference to horizontal, or by driving the main support into either the lowered or the raised positions, thereby causing the individual actuators to meet the ends of their travels. If one actuator reaches the end of its travel first and the other is continued to be driven to the end of its travel, then the main support 22 will automatically come into a horizontal position. Similarly, if there is a slight variation in travel due to the weight differences at the ends of the main frame 24, although the frame may tilt very marginally in travelling, it will meet the horizontal position at the end of its travel. It has been found that with a suitable mechanical advantage in the actuators, this is not a problem.

As seen in FIG. 3, when the bed frame is moved on the support surface, it will normally be moved in the lowered position with the castors 102, 104 (FIG. 1) on the surface. The bumper rail 78 can then be used to meet a wall to locate the bed frame relative to the wall. As the main support 24 is raised, the feet 98 will remain in place and the wheels 74, 76 (FIG. 1) will move towards the feet taking the bumper rail 78 away from the wall.

In the preferred embodiment, the wheels 76 and castors 104 have diameters of 7.6 cm; the outer links 60 and 160 have a length of 48.3 cm between axes of rotation; the overall height of the bed frame 20 in the lowered position (without mattress frame 106) is 16.2 cm with a clearance above the support surface between castors and wheels of 5.4 cm.

It will be evident that variations can be made to the described embodiments and such variations are within the scope of the invention as claimed.

What is claimed is:

1. An adjustable bed frame including:

an elongate main support extending longitudinally and having head and foot ends and moveable between raised and lowered positions;

an independent first elevating mechanism coupled to the main support;

an independent second elevating mechanism coupled to the main support and spaced from the first elevating mechanism to combine with the first elevating mechanism to carry the main support on a support surface;

an electrical supply system coupled to the first and second elevating mechanisms to provide power to actuate the mechanisms to change the height of the main support above said support surface between the raised and lowered positions;

a controller coupled to the supply system to selectively activate the first and second elevating mechanisms to move the main support between raised and lowered positions; and each of the first and second elevating mechanisms including a DC motor and a worm drive coupled to the DC motor, the worm drive having stops corresponding to said raised and lowered positions so that on using the controller to move the independent first and second elevating mechanisms to bring the main support into said raised or lowered positions, the worm drives will meet the corresponding stops to ensure the main support is horizontal in the raised and lowered positions, each of the first and second elevating mechanisms includes pairs of outer and inner links arranged in parallel, the outer links being rotatable about transverse first axes above the main frame, the inner links being rotatable about transverse second axes vertically below the corresponding first axes and below the main frame, and the respective pairs of inner and outer links of the first and second elevating mechanisms extending from the associated first and second axes away from one another.

2. An adjustable bed frame as claimed in claim 1 in which the pairs of inner and outer links of the first elevating mechanism are pivotally coupled to respective first upright elements, the first elevating mechanism including a pair of wheels attached one to each of the first upright elements for engagement on the support surface, and in which the inner and outer links of the second elevating mechanism are pivotally coupled to second upright elements, the second elevating mechanism including a pair of feet attached to the second upright elements for engagement on the support surface to locate the bed frame on the support surface as the main support is moved between the raised and lowered positions, the wheels providing horizontal movement over the support surface to accommodate angular motion of said outer and inner links in the first and second elevating mechanisms.

3. An adjustable bed frame as claimed in claim 2 in which said inner and outer links are parallel to the elongate main support and adjacent the main support with the main support in the lowered position.

4. An adjustable bed frame as claimed in claim 2 in which said outer links of the first and second elevating mechanisms are horizontal with the main support in the lowered position.

5. An adjustable bed frame as claimed in claim 4 in which the outer links extend from the respective first axes towards the respective head and foot ends of the main support with the main support in the lowered position.

6. An adjustable bed frame including:

an elongate main support extending longitudinally and having head and foot ends and moveable between raised and lowered positions;

an independent first elevating mechanism coupled to the main support;

an independent second elevating mechanism coupled to the main support and spaced from the first elevating mechanism to combine with the first elevating mechanism to carry the main support on a support surface;

an electrical supply system coupled to the first and second elevating mechanisms to provide power to actuate the mechanisms to change the height of the main support above said support surface between the raised and lowered positions;

a controller coupled to the supply system to selectively activate the first and second elevating mechanisms to move the main support between raised and lowered positions; and each of the first and second elevating mechanisms including pairs of outer and inner links arranged in parallel, the outer links being rotatable about transverse first axes above the main frame, and the inner links being rotatable about transverse second axes positioned below the corresponding first axes below the main frame such that with the bed frame in the lowered position the respective pairs of first links are in horizontal alignment adjacent to and immediately above the main support and the respective pairs of second links are in horizontal alignment adjacent to and immediately below the main support.

7. An adjustable bed frame as claimed in claim 6 in which with the main support in the lowered position there is a clearance between the support surface and the main support between the first and second elevating mechanisms for receiving equipment such as a patient lifting structure.

8. An adjustable bed frame as claimed in claim 6 in which the respective first and second elevating mechanisms extend from the associated first and second axes towards the respective head and foot ends of the main support.

9. An adjustable bed frame as claimed in claim 8 in which the pairs of inner and outer links of the first elevating mechanism are pivotally coupled to respective first upright elements, the first elevating mechanism including a pair of wheels attached one to each of the first upright elements for engagement on the support surface, and in which the inner and outer links of the second elevating mechanism are pivotally coupled to second upright elements, the second elevating mechanism including a pair of feet attached to the second upright elements for engagement on the support surface to locate the bed frame on the support surface as the main support is moved between the raised and lowered positions, the wheels providing horizontal movement over the support surface to accommodate angular motion of said outer and inner links in the first and second elevating mechanisms.

10. An adjustable bed frame as claimed in claim 9 in which the wheels are adjacent the head end of the main support and the feet are adjacent the foot and of the main support with the main support in the lowered position.

11. An adjustable bed frame as claimed in claim 10 and further including a castor assembly coupled to the main support adjacent the second elevating mechanism and having a pair of castors which contact the support surface only when the main support is moved into the lowered position so that in the lowered position the bed frame is supported on the wheels and castors to facilitate moving the bed frame on the support surface.

12. An adjustable bed frame as claimed in claim 8 and further including a castor assembly coupled to the main support adjacent the second elevating mechanism and having a pair of castors which contact the support surface only when the main support is moved into the lowered position so that in the lowered position the bed frame is supported on the wheels and castors to facilitate moving the bed frame on the support surface.

13. An adjustable bed frame as claimed in claim 6 in which with the main support in the lowered position, the bed frame has a height above the support surface of about 16.2 cm.

14. An adjustable bed frame as claimed in claim 13 in which the clearance under the main support between the first and second elevating mechanism is about 5.4 cm.

15. An adjustable bed frame as claimed in claim 6 in which each of the first and second elevating mechanisms including a DC motor and a worm drive coupled to the DC motor, the worm drive having stops corresponding to said raised and lowered positions so that on using the controller to move the independent first and second elevating mechanisms to bring the main support into said raised or lowered positions, the worm drives will meet the corresponding stops to ensure the main support is horizontal in the raised and lowered positions.

* * * * *